US008678558B2

(12) United States Patent
Hotta

(10) Patent No.: US 8,678,558 B2
(45) Date of Patent: Mar. 25, 2014

(54) LIQUID EJECTION HEAD AND LIQUID EJECTION DEVICE

(75) Inventor: Akira Hotta, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/546,310

(22) Filed: Jul. 11, 2012

(65) Prior Publication Data

US 2013/0016161 A1 Jan. 17, 2013

(30) Foreign Application Priority Data

Jul. 12, 2011 (JP) ..... 2011-153604

(51) Int. Cl.
*B41J 2/05* (2006.01)
*B41J 2/045* (2006.01)

(52) U.S. Cl.
USPC ..... 347/65; 347/68; 347/70

(58) Field of Classification Search
None
See application file for complete search history.

(56) References Cited

U.S. PATENT DOCUMENTS 6,024,436 A * 2/2000 Katakura et al. ..... 347/40
7,399,060 B2 * 7/2008 Tsuchii ..... 347/47

FOREIGN PATENT DOCUMENTS

JP 11-309877 11/1999

* cited by examiner

*Primary Examiner* — Geoffrey Mruk
(74) *Attorney, Agent, or Firm* — Harness, Dickey & Pierce, P.L.C.

(57) ABSTRACT

A liquid ejection head includes a nozzle plate, and a flow path member that is bonded to the nozzle plate, wherein the individual flow path includes a communicating portion that communicates with the nozzle openings and a pressure generating chamber that communicates with the communicating portion and has a width narrower than that of the communicating portion in the first direction, and wherein, in the flow path member, a first individual flow path row in which corresponding individual flow paths are arranged side by side in the first direction and a second individual flow path row where corresponding individual flow paths are arranged side by side in the first direction are arranged side by side in a second direction intersecting with the first direction, and each communicating portion of the second individual flow path row is provided between the pressure generating chambers of the first individual flow path row.

8 Claims, 6 Drawing Sheets

LIQUID EJECTION HEAD AND LIQUID EJECTION DEVICE

BACKGROUND

1. Technical Field

The present invention relates to a liquid ejection head and a liquid ejection device which eject a liquid from nozzle openings, and particularly, to an inkjet recording head and an inkjet recorder which eject ink as a liquid.

2. Related Art

As a representative example of a liquid ejection head, for example, an inkjet recording head that ejects ink droplets from nozzle openings by causing a pressure change in ink in a pressure generating chamber communicating with the nozzle openings has been known.

In the inkjet recording head, in order to very densely arrange the nozzle openings, so-called staggered arrangement in which a first nozzle row in which the nozzle openings are arranged side by side in a first direction and a second nozzle row in which the nozzle openings are arranged in a second direction intersecting with the first direction offset in the first direction so as not to be in the same position in the second direction has been proposed (for example, see JP-A-11-309877).

However, when the nozzle openings are provided in the zigzag arrangement, it is necessary that a width of an individual flow path of the pressure generating chamber and the like in a parallel installation direction (the first direction) is reduced, but there are difficulties in positioning between the individual flow path and nozzle openings of a nozzle plate when the width of the individual flow path is reduced, so that high positioning accuracy is required.

In addition, this kind of problem is not generated only in the inkjet recording head, but generated even in a liquid ejection head that ejects a liquid other than ink.

SUMMARY

An advantage of some aspects of the invention is to provide a liquid ejection head and a liquid ejection device which may obtain higher arrangement density of nozzle openings and easily position a nozzle plate and individual flow paths to thereby suppress trouble such as defective ejection of a liquid, and the like.

According to an aspect of the invention, there is provided a liquid ejection head, including: a nozzle plate on which a plurality of nozzle openings are arranged side by side in a first direction; and a flow path member that is bonded to the nozzle plate, wherein the flow path member includes individual flow paths that communicate with each of the nozzle openings, wherein the individual flow path includes a communicating portion that communicates with the nozzle openings and a pressure generating chamber that communicates with the communicating portion and has a width narrower than a width of the communicating portion in the first direction, and wherein, in the flow path member, a first individual flow path row in which corresponding individual flow paths are arranged side by side in the first direction and a second individual flow path row in which corresponding individual flow paths are arranged side by side in the first direction are arranged side by side in a second direction intersecting with the first direction, and each communicating portion of the second individual flow path row is provided between the pressure generating chambers of the first individual flow path row.

According to the aspect of the invention, by making a width of the communicating portion in the first direction greater than that of the pressure generating chamber, a high accuracy in positioning between the communicating portion and the nozzle openings may not be required, thereby easily performing the positioning. As a result, it is possible to suppress defective ejection of a liquid due to displacement between the communicating portion and the nozzle openings. In addition, by arranging the communicating portion of the second individual flow path row between the pressure generating chambers of the first individual flow path row, an interval between the pressure generating chambers adjacent to each other in the first direction may be reduced, thereby increasing arrangement density of the nozzle openings communicating with the pressure generating chamber in the first direction.

Here, it is preferable that a width of the pressure generating chamber in the first direction become narrowed on a side communicating with the communicating portion, and the communicating portion of the second individual flow path row be provided between communicating sides with the communicating portion of the pressure generating chambers of the first individual flow path row. Due to this, by arranging the communicating portion of the second individual flow path row between portions in which the width of the pressure generating chamber of the first individual flow path row becomes narrower, an interval between the pressure generating chambers adjacent to each other in the first direction may be further reduced, thereby increasing arrangement density of the nozzle openings communicating with the pressure generating chamber in the first direction.

In addition, it is preferable that a distance from the pressure generating chamber to the nozzle openings be provided with the same length on each of the individual flow paths. Due to this, it is possible to suppress occurrence of variations in ejection characteristics of liquid droplets ejected from each of the nozzle openings, in particular, an ejection velocity or an ejection weight.

In addition, it is preferable that the communicating portion and the nozzle openings be communicated with each other through a nozzle communicating hole provided so as to penetrate in a laminated direction between the nozzle plate and the flow path member. Due to this, a width of the communicating hole in the first direction may be increased by matching the communicating portion having a wide width, so that a high accuracy in positioning between the communicating hole and the nozzle openings may not be required, thereby easily performing the positioning.

According to another aspect of the invention, there is provided a liquid ejection device including the liquid ejection head.

According to the aspect of the invention, impacting position to a medium to be ejected with a liquid may be provided at a high density, and positioning between the nozzle plate and the individual flow paths may be easily performed, thereby realizing a liquid ejection device that prevents trouble such as defective ejection of a liquid, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

First Embodiment

Figure 1:
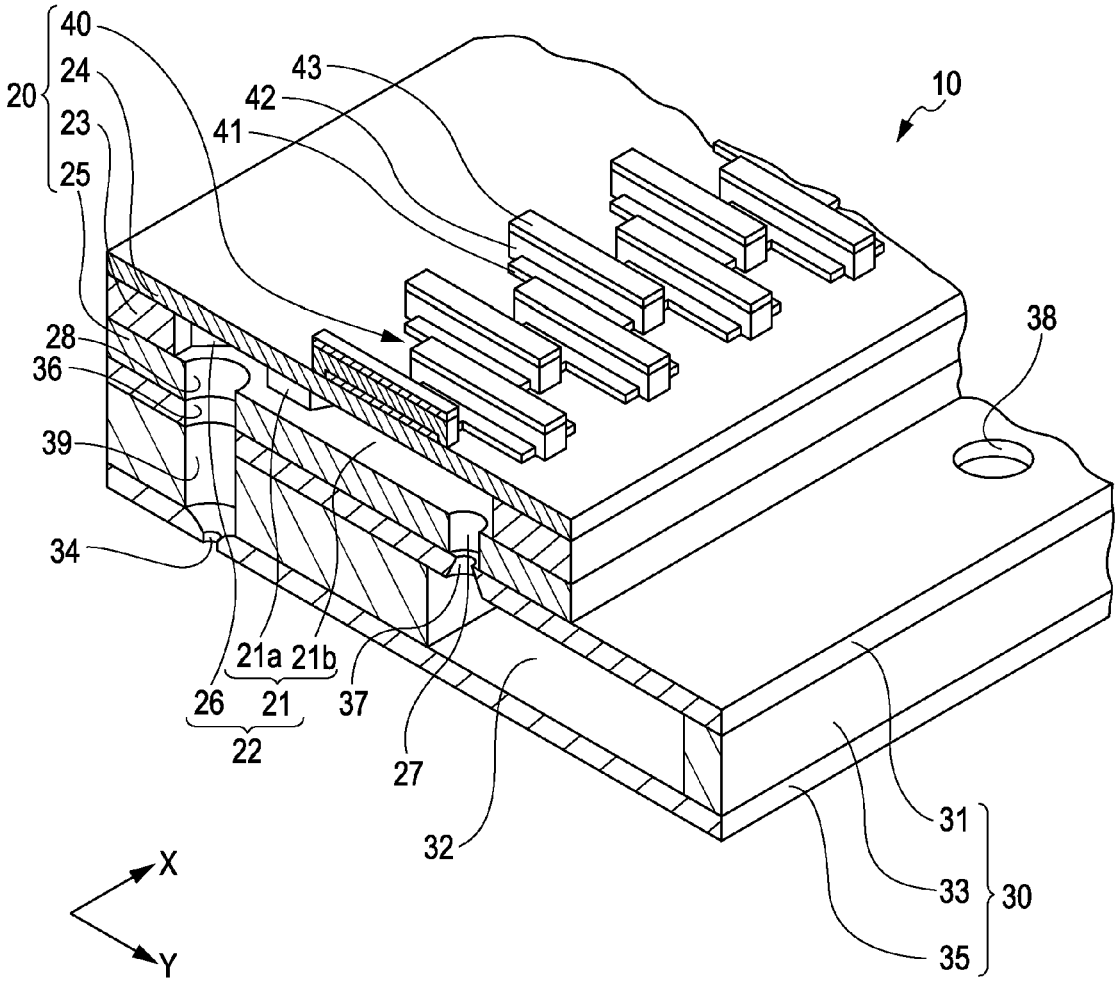
FIG. 1 is a perspective view obtained by cutting away main portions of a recording head, according to first embodiment of the invention.
Figure 2A:
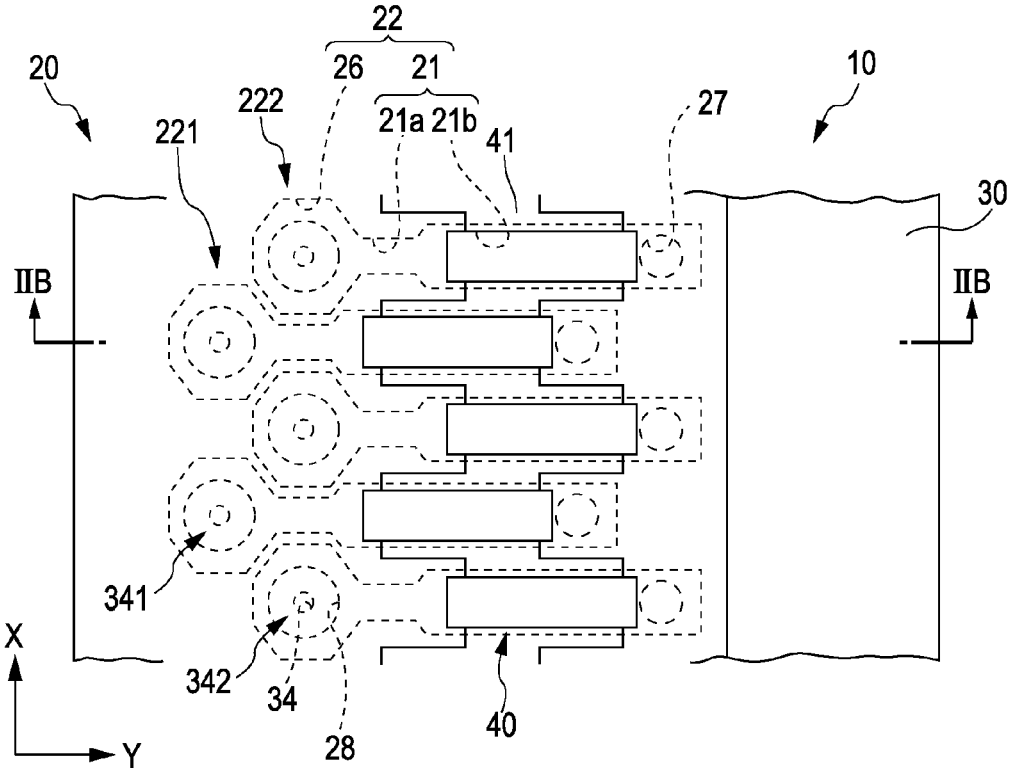
FIGS. 2A and 2B are a plan view and a cross-sectional view showing a recording head according to a first embodiment of the invention.
Figure 2B:
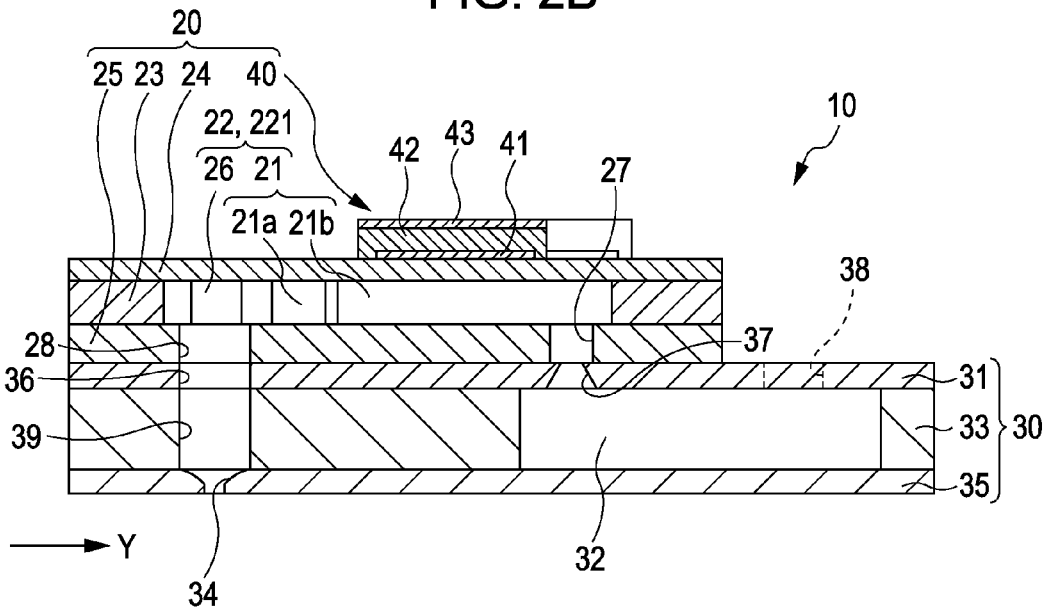
Figure 3:
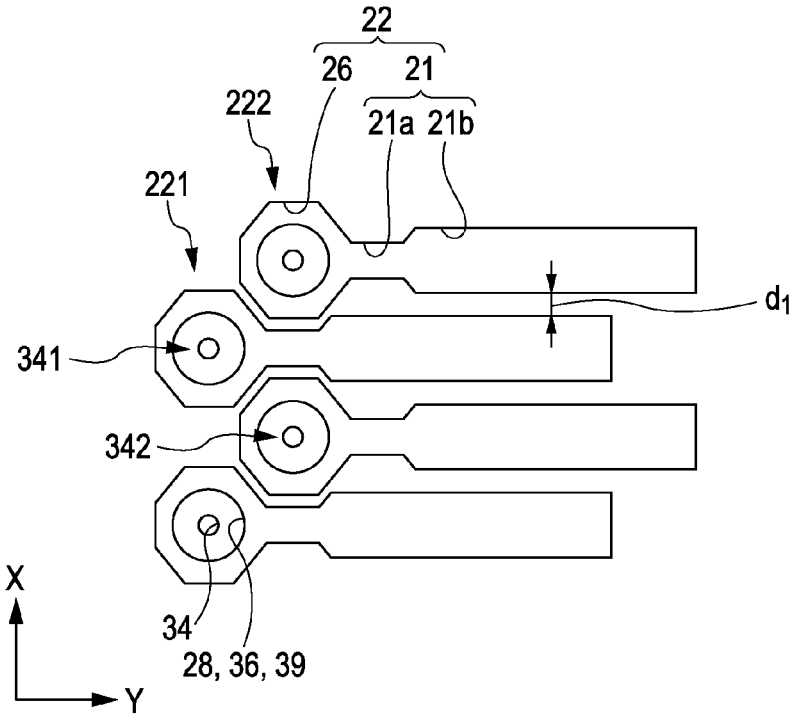
FIG. 3 is a plan view showing a flow path of a recording head according to a first embodiment of the invention.

FIG. 1 is a perspective view obtained by cutting away major portions of an inkjet recording head which indicates an example of a liquid ejection head according to a first embodiment of the invention, FIG. 2A is a plan view showing a piezoelectric element side of an inkjet recording head and FIG. 2B is a cross-sectional view taken along line IIB-IIB of the piezoelectric element, and FIG. 3 is a plan view showing an individual flow path of an inkjet recording head.

As shown in the drawings, an inkjet recording head 10 according to the present embodiment includes an actuator unit 20 and a flow path unit 30 in which the actuator unit 20 is fixed.

The actuator unit 20 is an actuator device including a piezoelectric element 40, and includes a flow path forming substrate 23 on which a pressure generating chamber 21 is formed, a vibration plate 24 provided on one surface side of the flow path forming substrate 23, and a pressure generating chamber bottom plate 25 provided on the other surface side of the flow path forming substrate 23.

The flow path forming substrate 23 is made of a ceramic plate having a thickness of about 150 μm such as alumina ($Al_2O_3$), zirconia ($ZrO_2$), and the like, and in the present embodiment, a plurality of pressure generating chambers 21 are arranged side by side in a first direction X.

An end of each of the plurality of pressure generating chambers 21 in a second direction Y is narrower than a width thereof in the first direction X. Specifically, the pressure generating chamber 21 includes a narrow width portion 21*a* in which the width in the first direction X is narrow formed on an end side of the pressure generating chamber 21 in the second direction Y, and a wide width portion 21*b* in which the width in the first direction X is wider than the narrow width portion 21*a* formed on the other side thereof.

In addition, on the narrow width portion 21*a* of the pressure generating chamber 21, a communicating portion 26 in which the width in the first direction X is wider than the pressure generating chamber 21 is provided. That is, on the flow path forming substrate 23, the communicating portion 26, the narrow width portion 21*a*, and the wide width portion 21*b* are arranged in the stated order along the second direction Y.

In the present embodiment, an opening of the communicating portion 26 is formed in a substantially hexagonal shape. Obviously, the shape of the opening of the communicating portion 26 is not particularly limited, and for example, a rectangle, a circle, or the like may be possible. In the present embodiment, the opening of the communicating portion 26 is formed in the substantially hexagonal shape, and therefore an opening of a nozzle communicating hole which will be described below is formed in a circular shape, or a diameter of the nozzle communicating hole is provided as large as possible. That is, this is because, when the shape of the opening of the communicating portion is a quadrangle or the like, the circular nozzle communicating hole inscribed on the quadrangle has a diameter smaller than that of a circle inscribed on a hexagon.

Specifically, the communicating portion 26 communicates with a nozzle opening 34, which will be described below, through the nozzle communicating hole, thereby supplying ink in the pressure generating chamber 21 to the nozzle opening 34.

The communicating portion 26 and the pressure generating chamber 21 constitute a part of the individual flow path 22. The individual flow paths 22 are arranged side by side in the first direction X, and the individual flow paths 22 adjacent to each other in the first direction X are arranged to be mutually offset in the second direction Y intersecting with the first direction X.

Specifically, two rows in which the individual flow paths 22 are arranged side by side in the first direction X are provided in the second direction Y. When one of the two rows of the individual flow paths 22 arranged in the second direction Y is a first individual flow path row 221, and the other thereof is a second individual flow path row 222, the individual flow paths 22 constituting the first individual flow path row 221 and the individual flow paths 22 constituting the second individual flow path row 222 are arranged alternately in the first direction X. That is, the individual flow paths 22 of the second individual flow path row 222 are arranged between the individual flow paths 22 of the first individual flow path row 221 (between the first direction X). Conversely, the individual flow paths 22 of the first individual flow path row 221 are arranged between the individual flow paths 22 of the second individual flow path row 222 (between the first direction X). In addition, between the pressure generating chambers 21 of the first individual flow path row 221, in the present embodiment, between the narrow width portions 21*a*, the communicating portion 26 of the second individual flow path row 222 is arranged. That is, each of the pressure generating chambers 21 of the first individual flow path row 221 are arranged side by side in the first direction X at the same position in the second direction Y, the communicating portion 26 of each of the individual flow paths 22 of the first individual flow path row 221 is positioned at the same position as that of the narrow width portion 21*a* of each of the pressure generating chambers 21 of the first individual flow path row 221 in the second direction. Due to this, the narrow width portion 21*a* of the first individual flow path row 221 and the communicating portion 26 of the second individual flow path row 222 are arranged alternately in the first direction X at the same position in the second direction Y.

Figure 4:
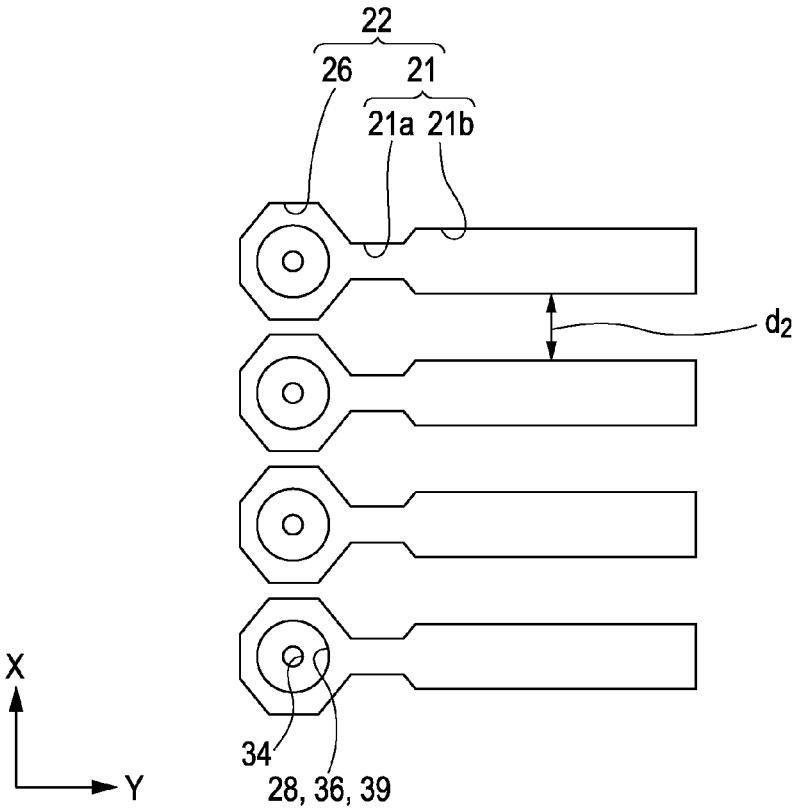
FIG. 4 is a plan view showing a comparative flow path of a recording head according to a first embodiment of the invention.

In this manner, between the pressure generating chambers 21 of the first individual flow path row 221 in the first direction X, particularly in the present embodiment, the narrow width portion 21*a* is provided in the pressure generating chamber 21, and the communicating portion 26 of the second individual flow path row 222 are provided between the narrow width portions 21*a*, and therefore an interval $d_1$ (in the present embodiment, an interval between the wide width portions 21*b*) between the pressure generating chambers 21 adjacent to each other in the first direction X can be narrowed even though a width of the communicating portion 26 in the first direction is wider than a width of the pressure generating chamber 21 (here, a width of the wide width portion 21*b*). In contrast, for example, as shown in FIG. 4, when the second direction Y is arranged at the same position in the first direction X without enabling the individual flow path 22 to be offset in the second direction Y, a width of the communicating portion 26 in the first direction X is wider than the width of the pressure generating chamber 21 (the wide width portion 21*b*), and therefore a wall having a predetermined thickness is required even between the communicating portions 26 adjacent to each other in the first direction X. For this reason, in an example shown in FIG. 4, an interval $d_2$ between the pressure generating chambers 21 (the wide width portion 21*b*) adjacent to each other in the first direction X is wider than the interval $d_1$, and therefore the nozzle openings 34 communicating with each of the individual flow paths 22 cannot be very densely arranged. As a result, ink droplets cannot be landed to a medium to be ejected at a high density.

In the present embodiment, the narrow width portion 21*a* in which a width in the first direction X is narrow is provided in the pressure generating chamber 21, and the communicating portion 26 in which a width in the first direction X is wider than the pressure generating chamber 21 (the wide width portion 21*b*) is arranged between two narrow width portions 21*a* in the first direction X, whereby the interval $d_1$ between the pressure generating chambers 21 adjacent to each other in the first direction X can be narrower than the interval $d_2$ even though the width of the communicating portion 26 is wider than the pressure generating chamber 21 (the wide width portion 21*b*). Accordingly, the pressure generating chambers 21 are very densely arranged in the first direction X, and the nozzle openings 34 communicating with each of the individual flow paths 22 are very densely arranged in the first direction X, and therefore ink droplets ejected from the nozzle openings 34 can be landed to the medium to be ejected at a high density in the first direction resulting in enabling high-resolution printing to be realized.

The vibration plate 24 formed of a thin plate made of stainless steel (SUS) having a thickness of 10 μm to 12 μm is fixed on one surface of the flow path forming substrate 23, and one surface of the pressure generating chamber 21 is sealed by the vibration plate 24.

In addition, on the vibration plate 24, a piezoelectric element 40 is provided in each of regions facing each of the pressure generating chambers 21, that is, regions facing the wide width portion 21*b* in the present embodiment.

Here, each of the piezoelectric elements 40 includes a lower electrode film 41 provided on the vibration plate 24, a piezoelectric layer 42 provided independently for each pressure generating chamber 21, and an upper electrode film 43 provided on each of the piezoelectric layers 42. The piezoelectric layer 42 is formed through attachment of a green sheet made of a piezoelectric material, for printing. The lower electrode film 41 is provided over the piezoelectric layers 42 arranged side by side to thereby be a common electrode of each of the piezoelectric elements 40, and thereby acts as a part of the vibration plate. Obviously, the lower electrode film 41 may be provided for each of the piezoelectric layers 42.

In addition, in the present embodiment, the pressure generating chambers 21 arranged side by side in the first direction X are arranged to be offset in the second direction Y for every other pressure generating chamber 21 described above. For this reason, the lower electrode film 41 according to the present embodiment is provided meandering in the second direction Y of the pressure generating chamber 21. That is, the pressure generating chambers 21 of the individual flow paths 22 of the first individual flow path row 221 are provided on the communicating portion 26 side in the second direction compared to the pressure generating chambers 21 of the individual flow paths 22 of the second individual flow path row 222, and therefore the lower electrode films 41 facing the pressure generating chambers 21 of the first individual flow path row 221 are provided on the communicating portion 26 side. In addition, the pressure generating chambers 21 of the individual flow paths 22 of the second individual flow path row 222 are provided on an opposite side of the communicating portion 26 in the second direction compared to the pressure generating chambers 21 of the individual flow paths 22 of the first individual flow path row 221, and therefore the lower electrode films facing the pressure generating chambers 21 of the second individual flow path row 222 are provided on the opposite side of the communicating portion 26. In addition, the lower electrode films 41 are continuously provided in the first direction X, and thereby are provided meandering in the first direction to match the pressure generating chambers 21 which are offset in the second direction Y.

In addition, the piezoelectric layer 42 and the upper electrode film 43 are arranged such that a center position of the corresponding piezoelectric element 40 is the same position in the second direction Y with respect to each of the pressure generating chambers 21. That is, the pressure generating chambers 21 of the first individual flow path row 221 and the second individual flow path row 222 are provided in different positions in the second direction Y, but a position of the piezoelectric element 40 in the second direction Y is arranged the same position with respect to each of the pressure generating chambers 21 regardless of the position of the pressure generating chamber 21 in the second direction. Due to this, when the piezoelectric element 40 is driven, variance in pressures fluctuation of ink in the pressure generating chamber 21 is prevented from being generated, and therefore it is possible to prevent variance in ejection characteristics when ink droplets are ejected from the nozzle opening 34 from being generated. That is, when variance in a position in the second direction with respect to the pressure generating chamber 21 of the piezoelectric element 40 is generated, pressure distribution in each of the pressure generating chambers 21 of the piezoelectric element 40 is not uniformalized and variance in the pressure distribution is generated, and therefore it is impossible to eject ink droplets from each of the nozzle openings 34 while having the same ejection characteristics, particularly, a flying velocity of the ink droplets or a weight of the ink droplets.

On the other surface opposite to the one surface on which the vibration plate 24 of the flow path forming substrate 23 is provided, the pressure generating chamber bottom plate 25 is provided.

The pressure generating chamber bottom plate 25 is fixed on the other surface side opposite to the vibration plate 24 of the flow path forming substrate 23 and seals the other surface of the pressure generating chamber 21. The pressure generating chamber bottom plate 25 includes a supply communicating hole 27 that is opened to an end side opposite to the communicating portion 26 of the pressure generating chamber 21 in the second direction Y, that is, on the wide width portion 21*b* side and communicates with the pressure generating chamber 21 and a manifold which will be described below, and a first nozzle communicating hole 28 that communicates with the nozzle opening 34 which will be described below while communicating with the communicating portion 26.

In the present embodiment, the first nozzle communicating hole 28 has a diameter larger than that of the supply communicating hole 27. In the present embodiment, in the first nozzle communicating hole 28, an opening opened to the communicating portion 26 in the first direction X has a larger width (can be referred to as "diameter" when the first nozzle communicating hole 28 is formed in a circular shape) than the narrow width portion 21*a* and the wide width portion 21*b* of the pressure generating chamber 21.

The flow path forming substrate 23, the vibration plate 24, and the pressure generating chamber bottom plate 25 which are respective layers of the actuator unit 20 are integrated without the need for adhesive by molding a clay-like ceramic material, so-called a green sheet in a predetermined thickness, for example, by drilling the pressure generating chambers 21 or the like and then laminating and firing the pressure generating chambers 21 at a high temperature. Thereafter, the piezoelectric element 40 is formed on the vibration plate 24.

Meanwhile, the flow path unit 30 includes a liquid supply port forming substrate 31 that is bonded to the pressure generating chamber bottom plate 25 of the actuator unit 20, a manifold forming substrate 33 on which a manifold 32 being a common ink chamber of the plurality of pressure generating chambers 21 is formed, and a nozzle plate 35 that is provided on an opposite side of the liquid supply port forming substrate 31 of the manifold forming substrate 33 to thereby seal the manifold 32 and includes the nozzle openings 34 provided thereon.

The liquid supply port forming substrate 31 is formed of a thin plate made of stainless steel (SUS) having a thickness of 60 μm, has a substantially the same diameter as that of the above-described first nozzle communicating hole 28, and is provided in such a manner that a liquid supply port 37 that is connected with the manifold 32 and the pressure generating chamber 21 together with a second nozzle communicating hole 36 communicating with the first nozzle communicating hole 28, the nozzle opening 34, and the pressure generating chamber 21, and the supply communicating hole 27 penetrates in the thickness direction (a laminated direction between the actuator unit 20 and the flow path unit 30). In addition, on the liquid supply port forming substrate 31, a liquid inlet 38 that communicates with each of the manifolds 32 and supplies ink from an external ink tank is provided. The liquid supply port 37 and the liquid inlet 38 are provided so as to communicate with each of both ends of the manifold 32, which will be described below, in the second direction. Further, in the present embodiment, a single liquid inlet 38 is provided so as to communicate with a center portion of the manifold 32 in the first direction.

On a plate material having corrosion resistance which is suitable for configuring an ink flow path (a liquid flow path) such as the stainless steel or the like of 150 μm, the manifold forming substrate 33 includes the manifold 32 that receives an ink supply from the external ink tank (not shown) and supplies the ink to the pressure generating chamber 21, and a third nozzle communicating hole 39 that has a substantially the same diameter as that of the second nozzle communicating hole 36 and communicates with the pressure generating chamber 21 and the nozzle opening 34 together with the first nozzle communicating hole 28 and the second nozzle communicating hole 36.

The manifold 32 is provided over the plurality of pressure generating chambers 21, that is, provided continuously over the first direction of the pressure generating chambers 21.

In addition, the third nozzle communicating hole 39 constitutes the nozzle communicating hole communicating with the pressure generating chamber 21 and the nozzle opening 34 together with the first nozzle communicating hole 28 and the second nozzle communicating hole 36.

That is, the nozzle communicating hole having the first nozzle communicating hole 28, the second nozzle communicating hole 36, and the third nozzle communicating hole 39 communicates with the pressure generating chamber 21 and the nozzle opening 34 in a laminated direction of the nozzle plate 35, the flow path forming substrate 23 that is the flow path member, the pressure generating chamber bottom plate 25, the liquid supply port forming substrate 31, and the manifold forming substrate 33. In addition, the individual flow paths 22 of the present embodiment include the pressure generating chambers 21, the communicating portion 26, and the nozzle communicating holes (the first nozzle communicating hole 28, the second nozzle communicating hole 36, and the third nozzle communicating hole 39).

The nozzle communicating holes are formed on the pressure generating chamber bottom plate 25 which is the flow path member, the liquid supply port forming substrate 31, and the manifold forming substrate 33 to match positions in the first direction X and the second direction Y of the communicating portion 26.

The nozzle plate 35 is formed of a plate-like member made of a metal such as stainless steel, etc., or a ceramic material such as silicon, etc. On the nozzle plate 35, the nozzle openings 34 penetrate at the same array pitch as that of the communicating portion 26, and are formed.

Specifically, the nozzle openings 34 includes a first nozzle row 341 communicating with the first individual flow path row 221, and a second nozzle row 342 communicating with the second individual flow path row 222. That is, the nozzle plate 35 includes the first nozzle row 341 in which the nozzle openings 34 are arranged side by side in the first direction X and the second nozzle row 342 in which the nozzle openings 34 are provided side by side in the first direction X, and the first nozzle row 341 and the second nozzle row 342 are arranged side by side in the second direction Y. In addition, the nozzle openings 34 of the second nozzle row 342 are arranged between two nozzle openings 34 of the first nozzle row 341 in the first direction X.

The flow path unit 30 is formed by fixing the liquid supply port forming substrate 31, the manifold forming substrate 33, and the nozzle plate 35 using adhesive, a heat welding film, or the like. In addition, in the present embodiment, the flow path forming substrate 23 and the pressure generating chamber bottom plate 25 of the actuator unit 20 which are the flow path member, and the liquid supply port forming substrate 31 and the manifold forming substrate 33 of the flow path unit 30 are provided.

Figure 5A:
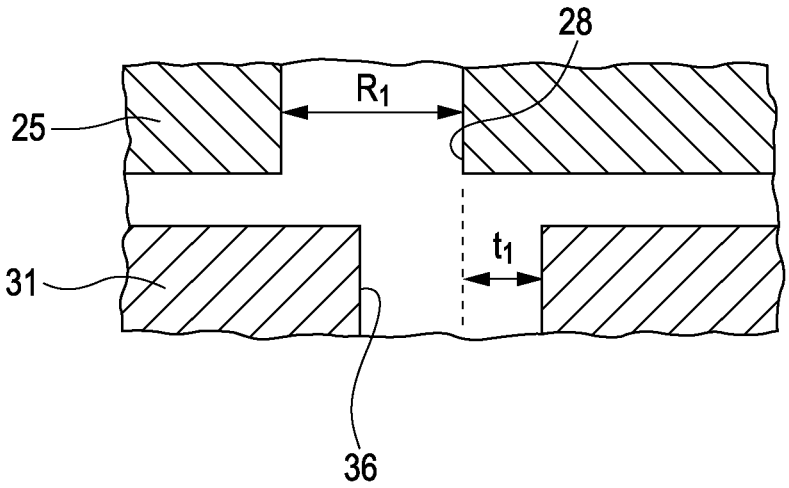
FIGS. 5A and 5B are cross-sectional views showing main portions of a recording head according to a first embodiment of the invention.
Figure 5B:
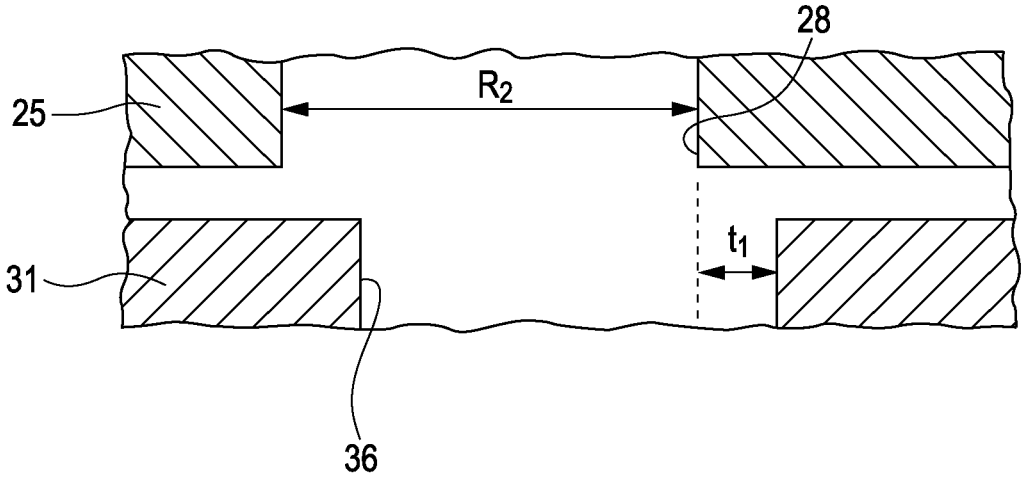

In addition, the liquid supply port forming substrate 31, the manifold forming substrate 33, and the nozzle plate 35 are positioned and bonded to each other so that the nozzle communicating holes (the first nozzle communicating hole 28, the second nozzle communicating hole 36, and the third nozzle communicating hole 39) communicate with the nozzle openings 34. In this instance, when an area of the opening of the nozzle communicating hole is small, it is difficult to position the pressure generating chamber bottom plate 25, the liquid supply port forming substrate 31, the first nozzle communicating hole 28, the second nozzle communicating hole 36, and the third nozzle communicating hole 39 of the manifold forming substrate 33. That is, comparison between a case in which a diameter $R_1$ between the first nozzle communicating hole 28 of the pressure generating chamber bottom plate 25 and the second nozzle communicating hole 36 of the liquid supply port forming substrate 31 is small as shown in FIG. 5A, and a case in which a diameter $R_2$ between the first nozzle communicating hole 28 and the second nozzle communicating hole 36 is larger than the diameter $R_1$ of FIG. 5A as shown in FIG. 5B is performed. When the diameters $R_1$ and $R_2$ of the nozzle communicating holes are different, even though the pressure generating chamber bottom plate 25 and the liquid supply port forming substrate 31 offset by the same amount $t_1$, a ratio in which the pressure generating chamber bottom plate 25 and the liquid supply port forming substrate 31 cover the entire opening area represented by the diameter $R_2$ of the nozzle communicating hole becomes smaller than a ratio in which the pressure generating chamber bottom plate 25 and the liquid supply port forming substrate 31 cover the entire opening area represented by the diameter $R_1$ of the nozzle communicating hole. In addition, when the ratio of covering the entire opening area of the nozzle communicating hole is small, supply characteristics to supply ink from the pressure generating chamber 21 to the nozzle opening 34 through the nozzle communicating hole, that is, a ratio in which a flow rate, a flow speed, or the like is reduced becomes smaller. In contrast, when the ratio of covering the entire opening area of the nozzle communicating hole is large, supply characteristics to supply ink from the pressure generating chamber 21 to the nozzle opening 34 through the nozzle communicating hole, that is, the ratio in which a flow rate, a flow speed, or the like is reduced becomes larger. Accordingly, even though variance in the amount $t_1$ of deviation is generated, it is possible to prevent the variance in the supply characteristics to supply ink to the nozzle opening 34 through the nozzle communicating hole from being increased by increasing the opening area of the ink communicating hole.

In addition, when the opening area of the nozzle communicating hole, particularly, the third nozzle communicating hole 39 is small, it is difficult to position between the nozzle communicating hole and the nozzle opening 34. For example, when the nozzle opening 34 is not completely opened in the nozzle communicating hole (the third nozzle communicating hole 39), and a part of the nozzle opening 34 is covered with the manifold forming substrate 33, ink droplets are not normally ejected from the covered nozzle opening 34. In addition, when the nozzle opening 34 is positioned to be offset in the first direction X or the second direction Y from a center of the nozzle communicating hole (the third nozzle communicating hole 39), flying curving of liquid droplets and the like may occur. In particular, when variance in the amount of deviation with respect to the nozzle communicating hole (the third nozzle communicating hole 39) of the nozzle opening 34 is generated, variance even in the flying curving of liquid droplets is generated, and therefore deviation in the impacting position of the ink droplets to a medium to be ejected may occur.

In the present embodiment, compared to a case in which the nozzle communicating hole which matches a width of the pressure generating chamber 21 is provided, the communicating portion 26 whose width is wider than a width of the pressure generating chamber 21 (the wide width portion 21*b*) in the first direction X is provided, so that the opening area of the nozzle communicating hole is increased to match the communicating portion 26, whereby positioning between the nozzle communicating hole (the third nozzle communicating hole 39) and the nozzle opening 34 is readily performed, and position deviation with respect to the nozzle communicating hole (the third nozzle communicating hole 39) of the nozzle opening 34 is suppressed to thereby suppress defective ejection of the ink droplets.

In the inkjet recording head 10 having the above-described configuration, the ink flow path reaching from the manifold 32 to the nozzle opening 34 is filled with ink by capturing ink from an ink cartridge (storage unit) into the manifold 32 through the liquid inlet 38, and then the vibration plate 24 is flexibly deformed together with the piezoelectric element 40 by applying a voltage to the piezoelectric element 40 corresponding to each of the pressure generating chambers 21 in accordance with a recording signal from a driving circuit which is not shown, and therefore pressure in each of the pressure generating chambers 21 is increased to cause ink droplets to be ejected from each of the nozzle openings 34.

As described above, the communicating portion 26 having a wider width than that of the pressure generating chamber 21 is provided, and therefore it is possible to suppress opening position deviation between respective members of the nozzle communicating holes communicating with the communicating portions 26 and the nozzle openings 34, or position deviation with the nozzle openings 34. In addition, the communicating portion 26 is provided, so that an interval between the pressure generating chambers 21 adjacent to each other in the first direction X is increased, but it is possible to reduce the interval between the pressure generating chambers 21 adjacent to each other in the first direction X by allowing the communicating portion 26 of the second individual flow path row 222 to be positioned between the pressure generating chambers 21 of the first individual flow path row 221. Accordingly, it is possible to very densely arrange the nozzle openings 34, which communicates, in each of the individual flow paths 22 in the first direction X, whereby an interval of ink droplets, landed to a medium to be ejected, in the first direction X is reduced, thereby realizing high-densification of the nozzle openings 34.

Other Embodiments

Figure 6:
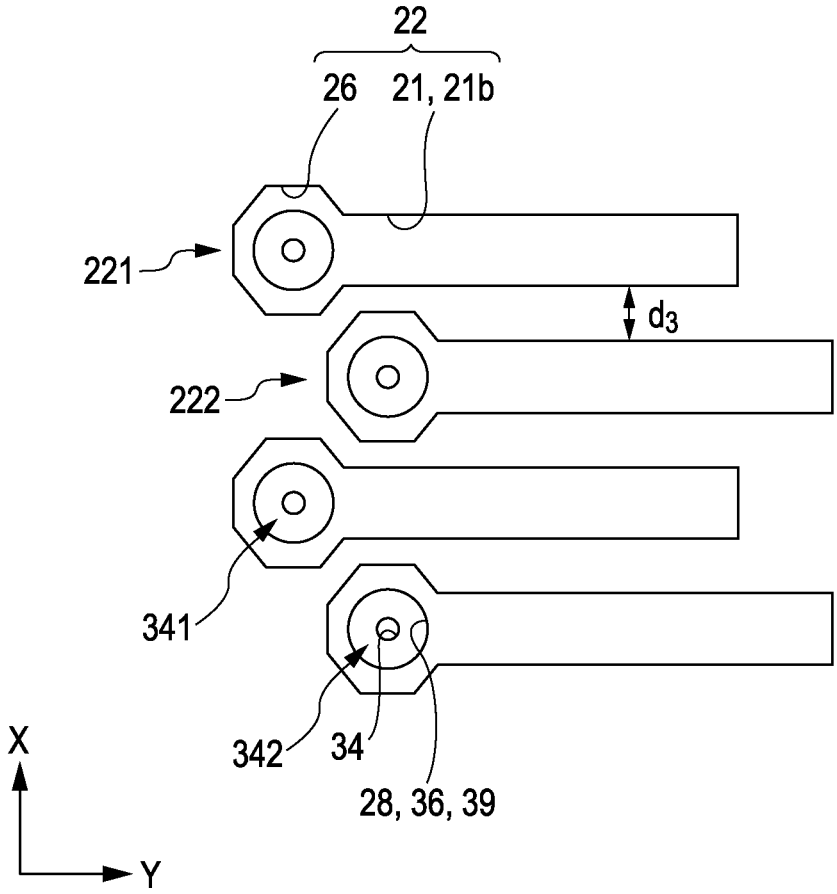
FIG. 6 is a plan view showing a flow path of a recording head according to another embodiment of the invention.

As above, an embodiment of the invention has been described, but a basic configuration of the invention is not limited to the above described embodiment. For example, in the above-described first embodiment, the pressure generating chamber 21 includes the narrow width portion 21*a* and the wide width portion 21*b*, and the communicating portion 26 of the second individual flow path row 222 is provided between the narrow width portions 21*a* of the first individual flow path row 221, but the invention is not limited thereto. For example, as shown in FIG. 6, when the narrow width portion 21*a* is not provided in the individual flow paths 22, that is, even when the pressure generating chamber 21 includes only the wide width portion 21*b*, the first individual flow path row 221 and the second individual flow path row 222 are arranged to be offset in the second direction Y, and therefore an interval $d_3$ between the pressure generating chambers 21 adjacent to each other in the first direction X can be narrower than the interval $d_2$ shown in FIG. 4. Obviously, the interval $d_1$ between the pressure generating chambers 21 adjacent to each other in the first direction X according to the above-described first embodiment is narrower than the interval $d_3$ shown in FIG. 6.

In the above-described first embodiment, the pressure generating chamber 21 of the individual flow path 22 constituting the second individual flow path row 222 also includes the narrow width portion 21*a* and the wide width portion 21*b*, but the pressure generating chamber 21 of the individual flow path 22 constituting the second individual flow path row 222 may not include the narrow width portion 21*a*, that is, include only the wide width portion 21*b*. However, the shapes of the pressure generating chambers 21 between the individual flow path 22 of the first individual flow path row 221 and the individual flow path 22 of the second individual flow path row 222 are different, and therefore difference in ejection characteristics of ink droplets may be caused. That is, as above-described first embodiment, when the individual flow path 22 of the first individual flow path row 221 and the individual flow path 22 of the second individual flow path row 222 are formed in the same shape, the ink ejection characteristics may be uniformalized, thereby improving printing quality.

In addition, in above-described first embodiment, an example in which the communicating portion 26 and the nozzle opening 34 communicate with each other through the ink communicating holes (the first nozzle communicating hole 28, the second nozzle communicating hole 36, and the third nozzle communicating hole 39) is illustrated, but the invention is not particularly limited thereto. For example, the communicating portion 26 and the nozzle opening 34 may directly communicate with each other. In this manner, even when the communicating portion 26 and the nozzle opening 34 directly communicate with each other, the width of the communicating portion 26 in the first direction X is wider than that that of the pressure generating chamber 21, and therefore a high accuracy in positioning between the communicating portion 26 and the nozzle opening 34 may not be required, thereby easily performing the positioning.

In addition, when the communicating portion 26 and the nozzle opening 34 directly communicate with each other, only the flow path forming substrate 23 may be used as the flow path member. In this manner, as the flow path member, a member formed such that the individual flow path 22 including the pressure generating chamber 21 and the communicating portion 26 is provided and bonded to the nozzle plate 35 may be used, and as the above-described first embodiment, a member including the flow path forming substrate 23, the pressure generating chamber bottom plate 25, the liquid supply port forming substrate 31, and the manifold forming substrate 33 may be used. Obviously, the invention is not limited to the above-described first embodiment, and other members may be provided between the flow path forming substrate 23 and the nozzle plate 35.

In addition, in the above-described first embodiment, the nozzle rows 341 and 342 in which the nozzle openings 34 are arranged side by side in the first direction X, and the nozzle row are arranged at two rows in the second direction Y, and the first individual flow path row 221 and the second individual flow path row 222 are provided, but the individual flow paths 22 which are arranged side by side in the first direction X may be provided at three rows or more in the second direction Y. For example, when the individual flow paths 22 are provided at three rows, the communicating portion 26 of a third individual flow path row that is a third row is arranged between the narrow width portions 21*a* of the second individual flow path row 222, and therefore a pitch of the nozzle opening 34 in the first direction X is narrowed, thereby realizing high-densification of the nozzle openings 34.

In addition, in the above-described first embodiment, the inkjet recording head 10 having the thick-film shaped piezoelectric element 40 has been exemplified, but as a pressure generating unit for causing pressure changes of the pressure generating chamber 21, the invention is not particularly limited to the inkjet recording head 10. For example, even though inkjet recording heads including a thin-film shaped piezoelectric element having a piezoelectric material formed by a sol-gel method, a MOD method, a sputtering method, or the like, a longitudinal vibration type piezoelectric element that is extended and retracted in the axial direction by laminating alternately a piezoelectric material and an electrode forming material, a so-called electrostatic actuator in which the vibration plate and an electrode are arranged with leaving a predetermined gap to thereby control vibration of the vibration plate by an electrostatic force, or a unit in which a heating element is arranged in the pressure generating chamber, and liquid droplets are ejected from the nozzle opening by bubbles generated by the heat of the heating element may be used, the same effects may be obtained.

Figure 7:
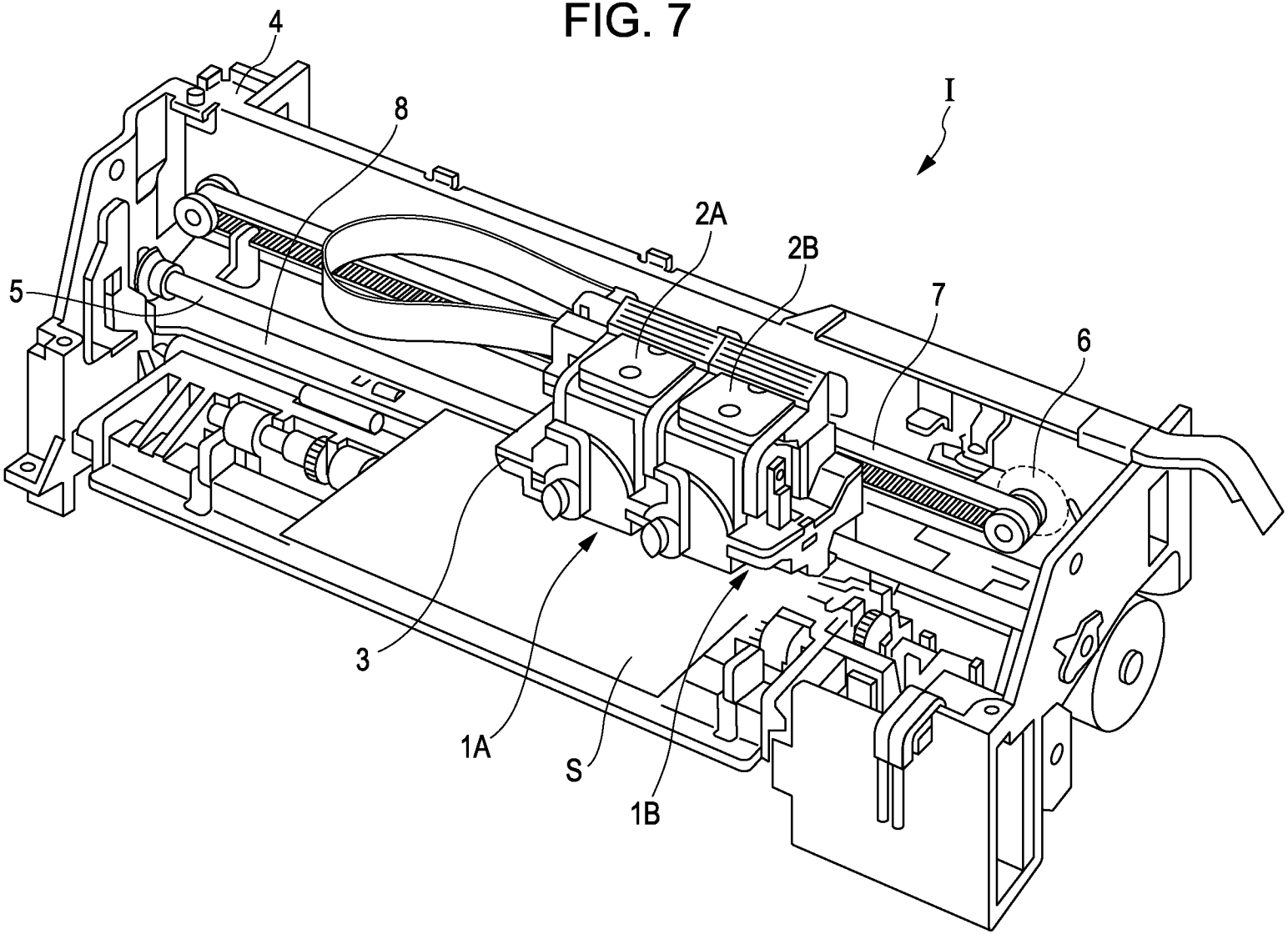
FIG. 7 is a schematic view showing an inkjet recording device according to an embodiment of the invention.

In addition, the inkjet recording head according to the present embodiment constitutes a part of a recording head unit including the ink flow path communicating with the ink cartridge, etc., and is mounted to an inkjet recording device. FIG. 7 is a schematic view showing an example of the inkjet recording device.

As shown in FIG. 7, the inkjet recording device I includes recording head units 1A and 1B having the inkjet recording head 10. In the recording head units 1A and 1B, cartridges 2A and 2B which constitute an ink supply unit are detachably mounted, and a carriage 3 including the recording head units 1A and 1B mounted therein is installed on a carriage shaft 5 mounted on a device main body 4 so as to be moved in the axial direction. The recording head units 1A and 1B respectively eject, for example, a black ink composition and a color ink composition.

In addition, a driving force of a driving motor 6 is transmitted to the carriage 3 through a plurality of gears, which are not shown, and a timing belt 7, so that the cartridge 3 including the recording head units 1A and 1B mounted therein is moved along the carriage shaft 5. Meanwhile, a platen 8 is installed along the carriage shaft 5 in the device main body 4, and a recording sheet S that is a recording medium such as paper or the like which is fed by a paper feeding roller not shown, or the like is wound around the platen 8 and transported.

In addition, in the above-described inkjet recording head device I, an example in which the inkjet recording head 10 (the head units 1A and 1B) is mounted on the carriage 3 and moved in a main scanning direction has been described, but the invention is not particularly limited thereto. For example, the invention may be applied to a so-called line type recording device in which the inkjet recording head 10 is fixed and printing is performed only by moving the recording sheet S such as paper or the like in a sub-scanning direction.

In addition, in the above-described embodiments, as an example of the liquid ejection head, the inkjet recording head has been described, but the invention may be widely applied to general liquid ejection heads. Obviously, the invention may be applied to a liquid ejection head for ejecting a liquid other than ink. As other liquid ejection heads, for example, a variety of recording heads used in an image recording device such as a printer, or the like, a color material ejection head used for manufacturing a color filter such as a liquid crystal display or the like, an electrode material ejection head used for forming an electrode such as an organic EL display, a field emission display (FED), or the like, a living organic matter ejection head used for manufacturing a bio chip, and the like may be used.

The entire disclosure of Japanese Patent Application No. 2011-153604, filed Jul. 12, 2011 is incorporated by reference herein.

What is claimed is:

1. A liquid ejection head, comprising:

a nozzle plate having a plurality of nozzle openings which are arranged side by side in a first direction;

a flow path member that is stacked above the nozzle plate;

a plurality of first individual flow paths provided to the flow path member and arranged side by side in the first direction, the plurality of first individual flow paths each having a communicating portion that communicates with one of the nozzle openings and a pressure generating chamber that communicates with the communicating portion in a second direction intersecting to the first direction and has a width narrower than a width of the communicating portion in the first direction; and a plurality of second individual flow paths provided in between the first individual flow paths in the flow path member respectively, the plurality of second individual flow paths each having a communicating portion that communicates with one of the nozzle openings and a pressure generating chamber that communicates with the communicating portion in a second direction intersecting to the first direction and has a width narrower than a width of the communicating portion in the first direction, wherein positions with respect to the second direction of the second individual flow paths are different from that of the first individual flow paths, each communicating portion of the second individual flow paths is provided between one pressure generating chamber of the first individual flow paths and the other pressure generating chamber of the first individual flow paths adjacent to the one pressure generating chamber in the first direction.

2. The liquid ejection head according to claim 1, wherein a distance from the pressure generating chamber to the nozzle openings is provided with the same length on each of the individual flow paths.

3. A liquid ejection device comprising the liquid ejection head according to claim 2.

4. The liquid ejection head according to claim 1, wherein the communicating portion and the nozzle openings are communicated with each other through a nozzle communicating hole provided so as to penetrate in a laminated direction between the nozzle plate and the flow path member.

5. A liquid ejection device comprising the liquid ejection head according to claim 4.

6. A liquid ejection device comprising the liquid ejection head according to claim 1.

7. The liquid ejection head according to claim 1, wherein the pressure generating chamber of the first individual flow paths has a width narrowed portion at a side of communicating with the communicating portion, the width narrowed portion has a width narrower than a width of the pressure generating chamber of the first individual flow paths in the first direction, the communicating portion of the second individual flow paths is provided between a first and a second width narrowed portion of the first individual flow paths arranged adjacent to each other in the first direction.

8. A liquid ejection device comprising the liquid ejection head according to claim 7.

* * * * *